US006040537A

United States Patent [19]

McClintock

[11] Patent Number: 6,040,537

[45] Date of Patent: Mar. 21, 2000

[54] FOOT OPERATED CONTROL UNIT

[75] Inventor: Larry E. McClintock, Putnam, Conn.

[73] Assignee: Linemaster Switch Corporation, Woodstock, Conn.

[21] Appl. No.: 08/846,736

[22] Filed: Apr. 30, 1997

[51] Int. Cl.[7] ..... H01H 21/26

[52] U.S. Cl. ..... 200/86.5; 74/513; 338/108

[58] Field of Search ..... 73/146; 307/119; 200/86.5; 74/478, 512, 513, 560; 338/108, 113, 153

[56] References Cited

U.S. PATENT DOCUMENTS

| | | |
|---|---|---|
| 1,461,380 | 7/1923 | Cole . |
| 2,103,557 | 12/1937 | Sawdey et al. . |
| 2,113,700 | 4/1938 | Martinet . |
| 2,330,385 | 9/1943 | Rubissow . |
| 2,628,507 | 2/1953 | Juergens . |
| 2,644,868 | 7/1953 | Locey . |
| 2,753,709 | 7/1956 | Beck . |
| 2,831,367 | 4/1958 | Reilly . |
| 3,359,821 | 12/1967 | Beardsley et al. . |
| 3,630,326 | 12/1971 | Kawaguchi . |
| 3,703,698 | 11/1972 | Nomura et al. . |
| 3,963,391 | 6/1976 | Thorburn et al. . |
| 4,046,049 | 9/1977 | Luce et al. . |
| 5,039,973 | 8/1991 | Carballo . |
| 5,051,550 | 9/1991 | Harris . |
| 5,319,996 | 6/1994 | Harris . |
| 5,497,677 | 3/1996 | Baumann . |
| 5,793,016 | 8/1998 | Colling . |

FOREIGN PATENT DOCUMENTS

| | | |
|---|---|---|
| 106 501 | 2/1943 | Sweden . |
| 1 449 862 | 9/1976 | United Kingdom . |

*Primary Examiner*—Gerald Tolin
*Attorney, Agent, or Firm*—Alix, Yale & Ristas, LLP

[57] ABSTRACT

A foot operated control unit for controlling a power circuit of an associated power driven device. The control unit includes at least one control mechanism which may be connected with the power circuit. The control unit also has a unitary base, composed of electrically non-conductive material, defining two mounting stations. Each mounting station includes a mounting bracket, a pair of positioning pins and a mounting slot in the base plate for mounting a control mechanism and an actuating lever. A foot operated unitary cover, or actuating member, composed of electrically non-conductive material is pivotally mounted to the base. The actuating lever cooperates with the actuating member to actuate the control mechanism in response to pivotal movement of the actuating member relative to the base.

19 Claims, 9 Drawing Sheets

FOOT OPERATED CONTROL UNIT

BACKGROUND OF THE INVENTION

This invention relates generally to control units for controlling the operation of associated power driven devices such as medical and dental equipment, power tools, recording equipment, office machines, and motor driven appliances. More particularly, the present invention relates to foot operated control units wherein the control unit is actuated by the foot of the operator to energize, de-energize, vary the speed or power output, or similarly control the operation of an associated power driven device.

As enumerated above, foot operated control units are utilized in a variety of applications. The electrical and electronic components required to perform each application are generally different from the electrical and electronic components that are required to perform each other application. Consequently, the housings, component mounting apparatus, and electrical insulation for such foot operated control units are generally custom designed for each application in order to properly mount and insulate the particular electrical and electronic components. The effort required to design such application specific apparatus and the cost of application specific tooling and/or molds for producing such apparatus represents a considerable expense.

The cover and base plate that comprise the housing for foot operated control units have generally been composed of metal to provide the required structural integrity and longevity. Consequently, such control units require internal electrical insulation to ensure that an electrical path may not be formed between the cover and baseplate and the electrical and electronic components housed within the cover and base plate. Due to space constraints within such control units, the insulation is often difficult to install. Recent material advances have allowed the housing for certain foot operated control units to be manufactured from plastic. However, such control units generally utilize metallic components to mount the electrical and electronic components within the housing. Therefore, such control units require insulation to prevent the formation of electrical paths between internal components. In addition, insulation may be required to ensure that an electrical path may not be formed via a metallic mounting component that penetrates the housing.

SUMMARY OF THE INVENTION

Briefly stated, the invention in a preferred form is a foot operated control unit for controlling a power circuit of an associated power driven device which includes at least one control mechanism which may be connected with the power circuit. The control unit also has a unitary base defining a plurality of mounting stations. Each mounting station includes a mounting bracket, a pair of positioning pins and a mounting slot in the base plate. A foot operated unitary cover, or actuating member, is pivotally mounted to the base. An actuating lever cooperates with the cover to actuate the control mechanism in response to pivotal movement of the cover relative to the base.

The base and cover are composed of an electrically non-conductive material. Therefore, insulating material is not required to insulate the switches from either the base, including the mounting brackets or the cover.

The cover has a downwardly extending skirt and the base has first and second mounting posts extending upward from its rear end portion. A mounting pin on each mounting post is received in an opening in the skirt to pivotally mount the cover to the base. The use of a single flexible mounting post that is integral with the base requires fewer parts than conventional control units, reducing the material costs and assembly time.

The rear end portion of the base also includes a cradle for receiving a cable. A cable clamp is mounted to the cradle to clamp the cable therebetween. One face of the cable clamp has a laterally extending arcuate recess for receiving and engaging cables having a relatively large diameter and another face of the cable clamp has a laterally extending arcuate protrusion for engaging cables having a relatively small diameter. The use of a cable clamp having large and small engagement faces provides flexibility of application and reduces material and assembly costs.

The use of multiple mounting stations allows the base and cover to be used for a number of application specific control units. In a first embodiment, a single switch, a single actuator lever, and a single spring are mounted to the base to form a single pole, double throw control. In a second embodiment two switches, two actuator levers and two springs are mounted to the base to form a two stage control. In a third embodiment, two switches, a single actuator lever and a single spring are mounted to the base is a double pole double throw control.

It is an advantage of the present invention that the a single unitary base may be utilized for a variety of application specific foot operated control units.

It is another advantage of the present invention that the requirement for internal insulation is reduced or eliminated.

It is a further advantage of the present invention that fewer components are required to assemble each control unit, reducing material and assembly costs.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
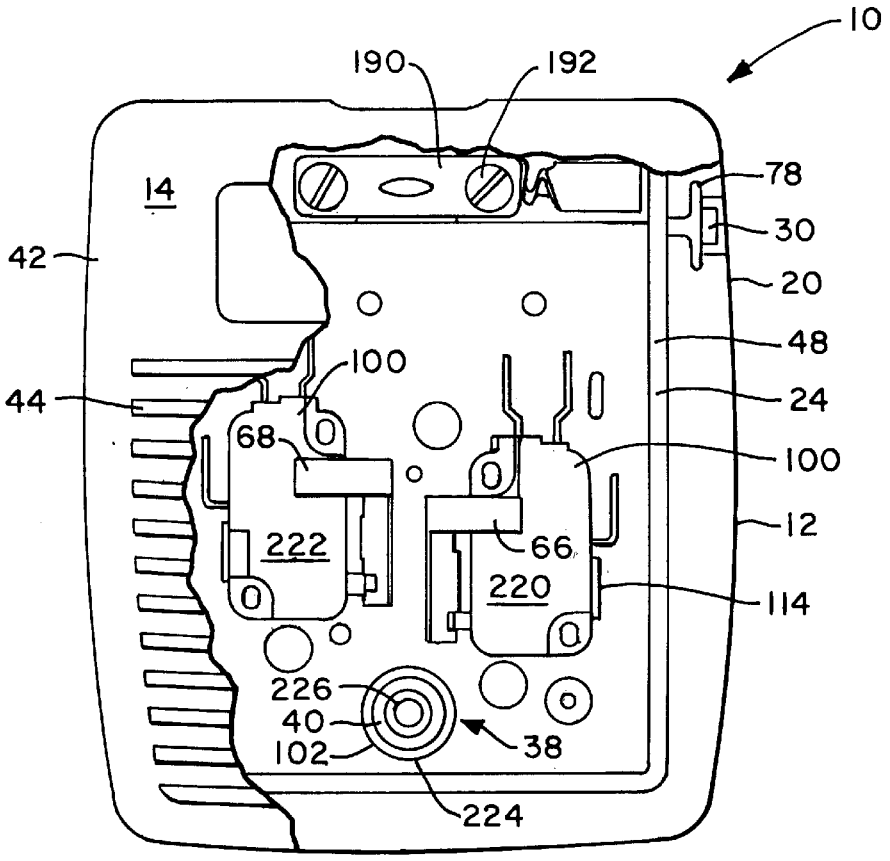
FIG. 1 is a top plan view of a first embodiment of a foot operated control device in accordance with the invention with the cover partly cut away.
Figure 2:
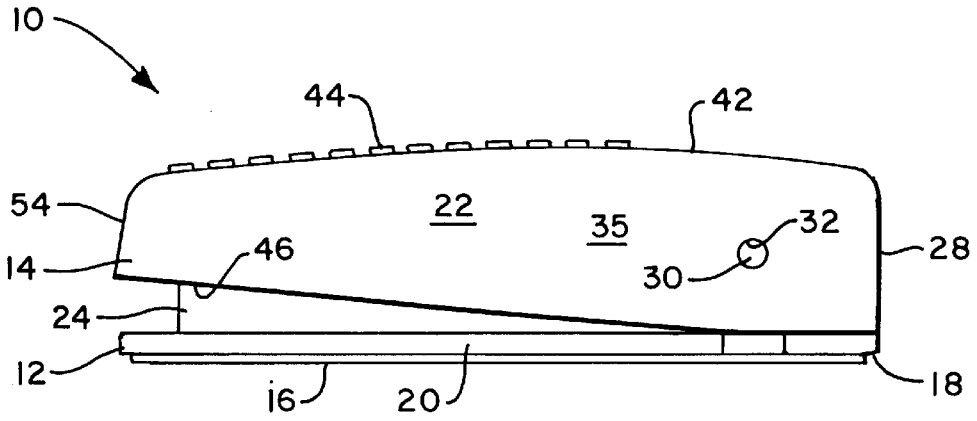
FIG. 2 is a side elevational view of the foot operated control device of FIG. 1.

With reference to the drawings wherein like numerals represent like parts throughout the several figures, a foot operated control unit in accordance with the present invention comprises a base 12 and a cover 14 that have a universal design that may be utilized to manufacture several different application specific apparatus. With reference to FIG. 1, the cover 14 and base 12 are each unitary structures, preferably molded from an electrically non-conductive polymeric material. As shown in FIG. 2, the base 12 has a resilient pad 16, preferably with a tread surface, adhered to its bottom surface 18. In use, the control unit 10 is adapted to be placed on a supporting surface, usually a floor. The resilient pad 16 effectively prevents the base from sliding on the floor. If desired, the base 12 can be permanently secured to the supporting surface by screws or other fasteners (not shown). In addition, the resilient pad 16 acts as an insulator to prevent operator contact with any metallic mounting components that might penetrate the base 12.

The cover 14 is substantially the same width and length as the base plate 20 of the base 12. The cover 14 has a canopy contour that includes a depending skirt 22 extending around its perimeter within which is received a rim 24 of the base 12 that extends upwardly from the base plate 20. The cover skirt 22 and the base rim 24 enclose and protect the interior components of the control unit 10, as shown in FIG. 1. A notch 26 in the rear portion 28 of the skirt 22 provides a passageway for an electrical cable (not shown).

Figure 11:
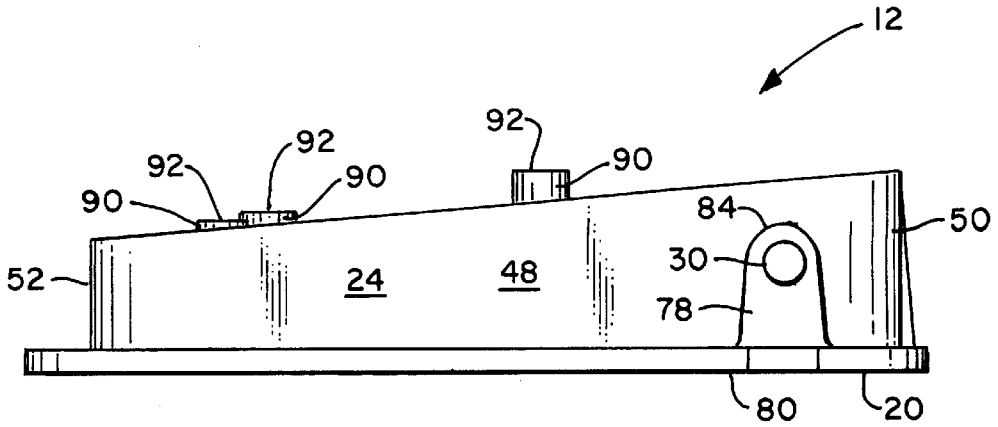
FIG. 11 is a side elevational view of the base of FIG. 5.

The cover 14, which is the actuating member of the control unit 10, is pivotally mounted to the base 12 by a pair of mounting pins 30 on the base that are received in complementary mounting holes 32 in each side of the skirt 22. A guide structure 34 disposed around each opening 32 comprises two ramp-shaped surfaces 36 that guide the mounting pins 30 of the base 12 into the openings 32 during assembly of the control unit 10. The front or forward end of the cover 14 is biased away from the base 12 by a spring mechanism 38 mounted on a base spring guide 40 projecting upwardly from the base plate 20. The cover 14 is dimensioned to accommodate the front portion of the foot of the person operating the control unit 10, the upper surface 42 of the cover 14 being provided with laterally extending ribs 44 to provide a non-skid surface for the operator's foot. The bottom edges 46 of both side portions 35 of the skirt 22 extend obliquely upward from a point substantially below the openings 32. Similarly, the side portions 48 of the rim 24 respectively slope downward from the rear portion 50 to the front portion 52 (FIG. 11). The reduced height of the front portions 54, 52 of the skirt 22 and rim 24, respectively, provides the clearance between the base 12 and cover 14 that is required for actuation of the control unit 10.

Figure 3:
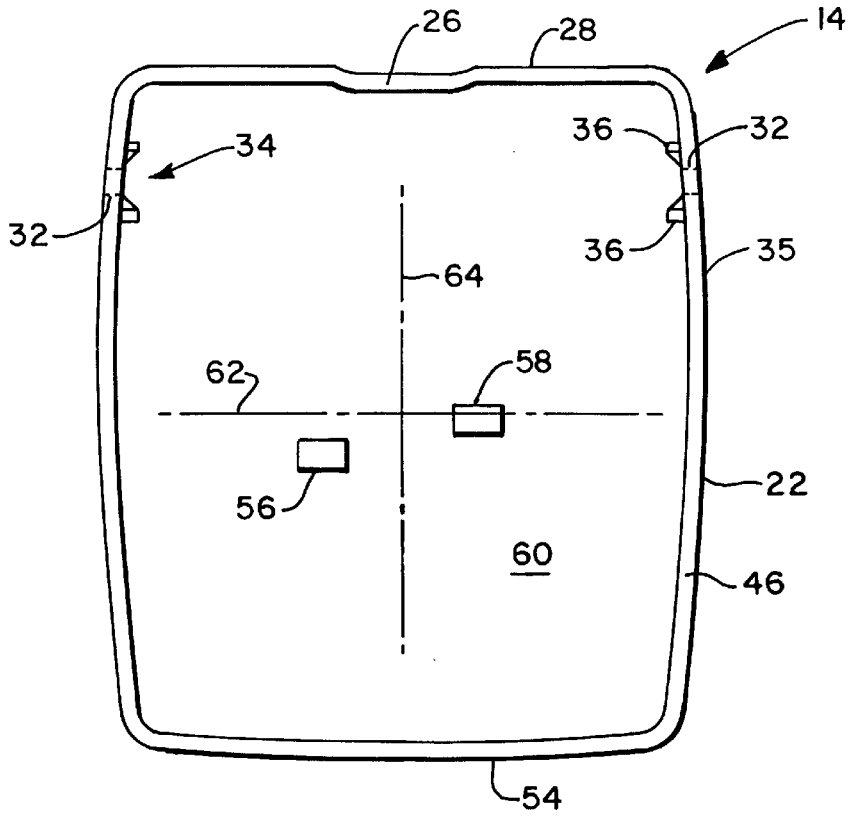
FIG. 3 is a bottom plan view of the cover of the foot operated control device of FIG. 1.

With reference to FIG. 3, two actuator pegs 56, 58 extend downwardly from the inside surface 60 of the cover 14. The second peg 58 is positioned substantially on a line 62 midway between the front and rear portions 54, 28 of the skirt 22 and to the left of the centerline 64 and the first peg 56 is positioned just below line 62 and to the right of the centerline 64 (when viewed from the top). The first and second pegs 56, 58 are engageable with the first and second actuator levers 66, 68 in the embodiment shown in FIG. 1.

As shown in FIGS. 5, 6, 9–11 and 17, the base 12 comprises a base plate 20 and a rim 24. A portion of the base plate 20 extends outwardly beyond the rim 24 to provide a platform that resists tipping when the operator applies pressure to the cover 14. Mounting posts 78, 80, for mounting the cover 14 to the base 12, extend upwardly from the rear end portion 82 of the base plate 20, exteriorly of the rim 24. A mounting pin 30 extends laterally outward from the upper end portion 84 of each mounting post 78, 80. A buttress 86 connects the first mounting post 78 to the rim 24 to prevent deflection of the mounting post 78. The thickness and material of the second mounting post 80 is selected such that the upper end portion 84 may be deflected inwardly toward the rim 24 to allow installation and removal of the cover. For example, a mounting post 80 composed of Noryl™ SE-1-GFN1 material and having a thickness of 0.055 inches will have sufficient flexibility.

Figure 5:
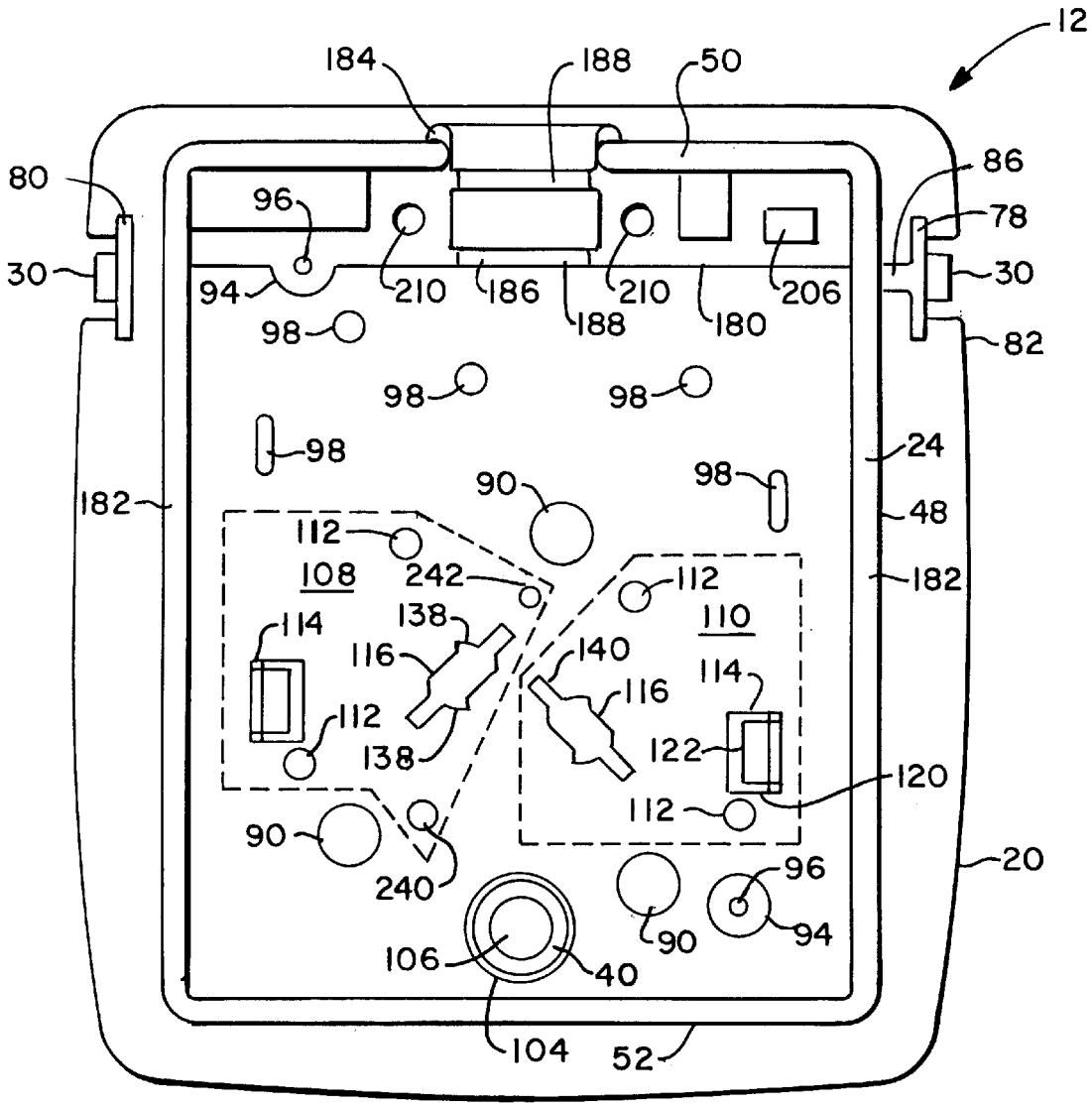
FIG. 5 is an enlarged top plan view of the base of the foot operated control device of FIG. 1.
Figure 17:
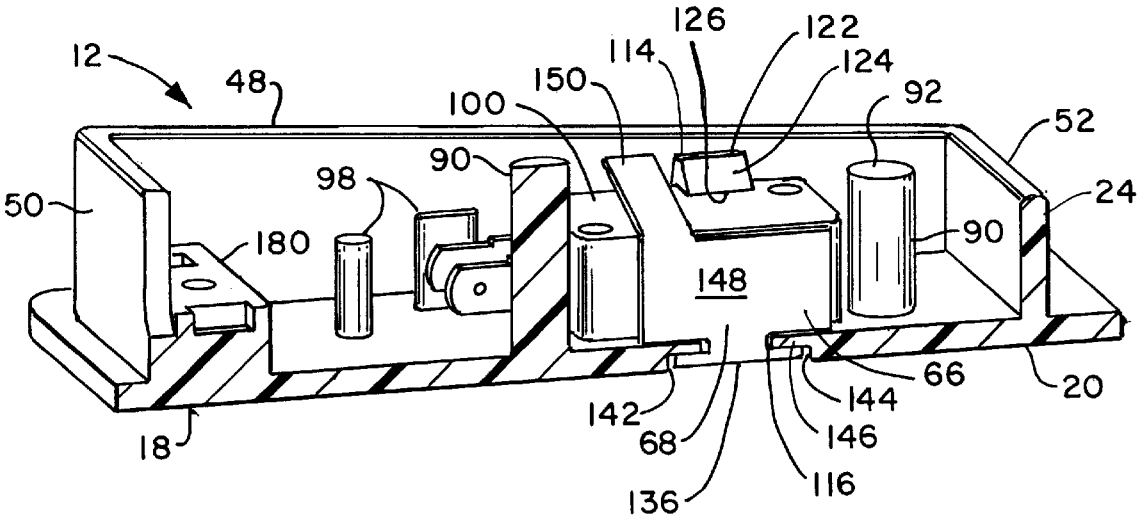
FIG. 17 is a perspective view of the base of FIG. 9 taken along line B—B of FIG. 9 with the cable clamp removed.

With reference to FIGS. 5 and 17, three structural bosses 90 extend upwardly from the base plate 20. The height of each boss 90 is selected such that the top surface 92 of each boss 90 engages the inner surface 60 of the cover 14 when the cover is depressed below the lowest actuation point. The support provided by the bosses 90 prevents crushing of the internal components. Two short mounting bosses 94 extend upwardly from the base plate 20. Openings 96 extending through each mounting boss 94 may receive a screw, or similar fastener (not shown) to mount the control unit 10 to the floor. A plurality of wire separators 98 also extend upwardly from the base plate 20. The wire separators 98 prevent the wires that are connected to one terminal of a switch 100 from contacting the wires that are connected to another terminal of the same switch, thereby ensuring that a short circuit will not occur. A spring guide 40, as mentioned, extends upwardly from the base plate 20. The spring guide is semi-cylindrical, having an outside diameter at its bottom end that is greater than the outside diameter at its top end. The tapered shape of the spring guide 40 allows the lower end of a spring 102 to be positioned around the spring guide 40 such that the spring engages the outside surface 104 of the spring guide 40. The lower end of a spring may also be inserted into the axially extending blind bore 106 defined by the spring guide 40.

Two switch mounting stations 108, 110 are provided within the rim 24 of the base 12 (shown by dotted lines in FIG. 5). Each mounting station 108, 110 includes a pair of positioning posts 112 and a mounting bracket or hook 114 which extend upwardly from the base plate 20 and an actuator lever mounting slot 116 that extends through the base plate 20. The thickness and shape of the shank 120 of each mounting bracket 114 is selected such that the head 122 may be flexed outwardly toward the rim 24. For example, a mounting bracket 114 composed of Noryl™ SE-1-GFN1 material and having a thickness of 0.053 inches will have sufficient flexibility. In the embodiment shown, the head 122 has a sloped top face 124 and a shoulder 126. A switch 100 may be installed by aligning the two openings 128 in the body 130 of the switch 100 (FIG. 4) with the positioning posts 112 and pressing the switch 100 down against the sloped top face 124 of the mounting bracket 114. Continued pressure will deflect the head 122 toward the rim 24, allowing the switch 100 to be pushed into contact with the base plate 20. The height of the shank 120 is greater than or equal to the height of the switch body 130. When the switch body 130 contacts the base plate 20, the head 122 snaps back into position and the shoulder 126 is disposed above the upper surface of the switch body 130 to lock the switch 100 in position as shown in FIG. 17.

Figure 6:
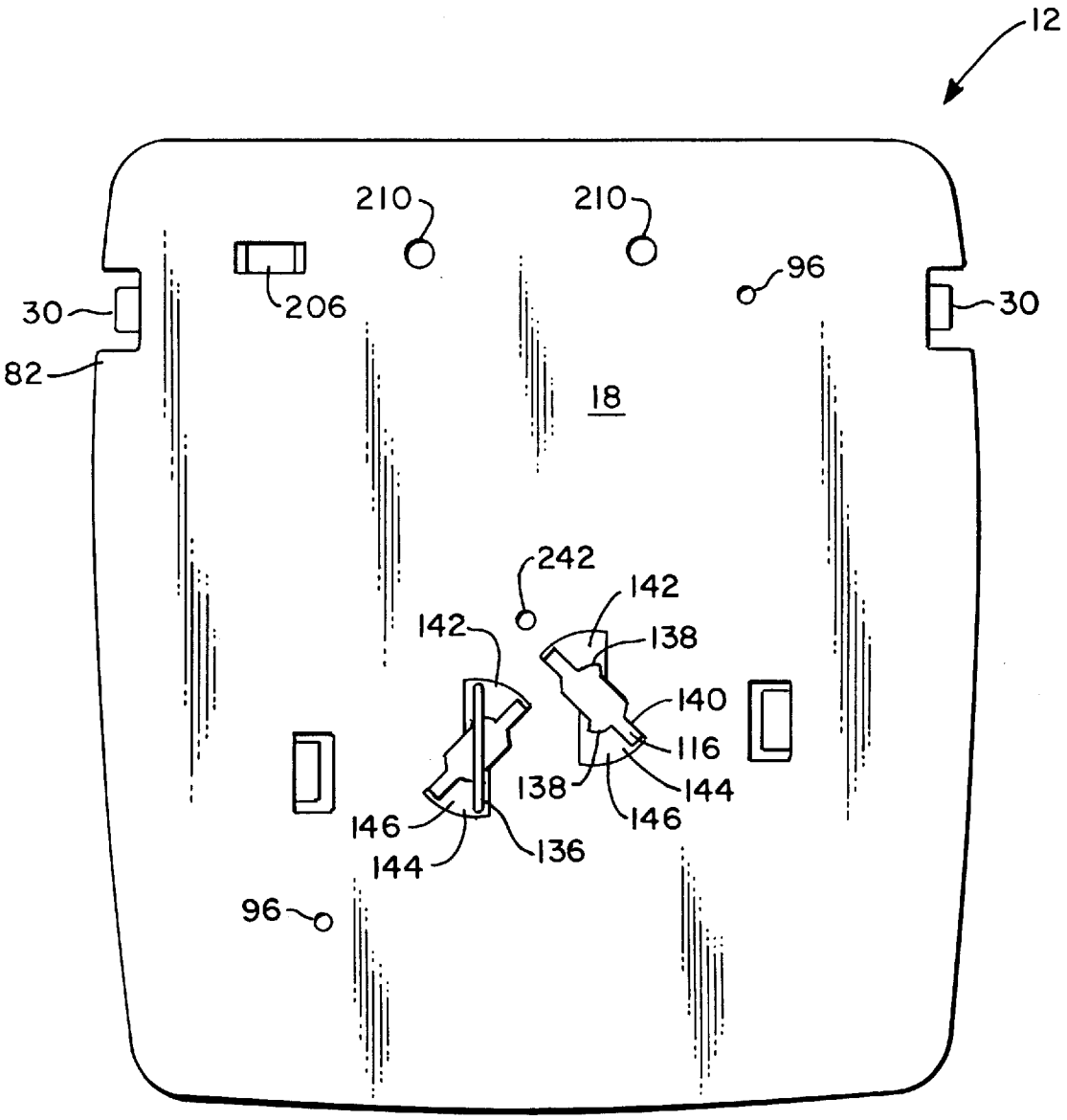
FIG. 6 is a bottom plan view of the base of FIG. 5 illustrating the extension member and tabs of one of the actuator levers of FIG. 1 in the installed position.

With reference to FIGS. 5 and 6, a substantially rectangular actuator lever mounting slot 116 is provided in each switch mounting station 108, 110 for receiving the mounting member 136 of an actuator lever 66, 68 such that the actuator lever 66, 68 is pivotally movable. Each mounting slot 116 includes a notch 138 in each of the long walls 140 of the slot 116. The bottom surface 18 of the base plate 20 includes a first recess 142 adjacent one of the long walls 140 of the slot 116 and a second recess 144 adjacent the other long wall 140 of the slot 116. Each recess 142, 144 extends substantially from the mid-point of the slot 116 to the end of the slot 116. The recesses 142, 144 each define a retention segment 146.

Figure 4:
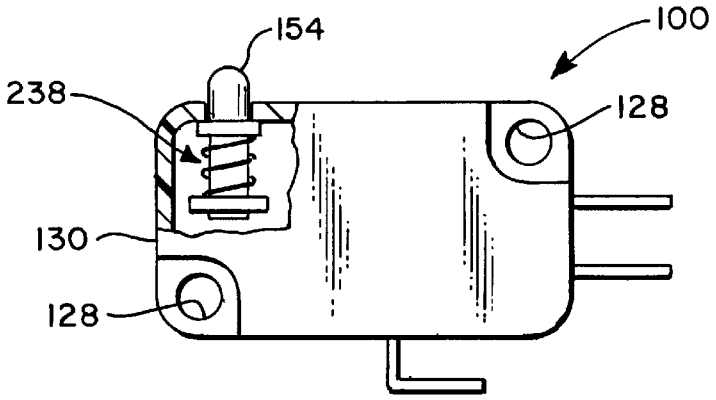
FIG. 4 is an enlarged top plan view of one of the switches of FIG. 1 with the housing partly cut away.
Figure 7:
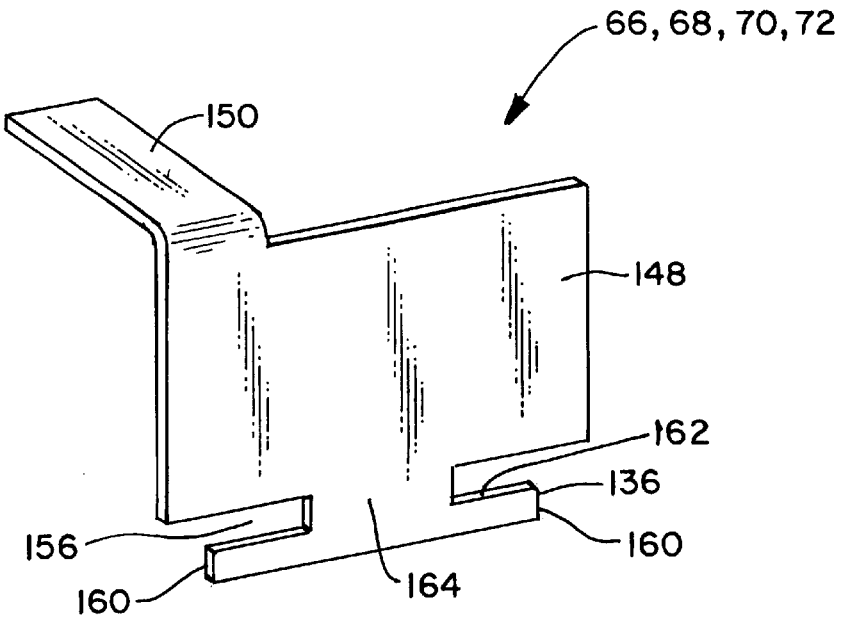
FIG. 7 is an enlarged side perspective view of an actuator lever used in the control device of FIG. 1.
Figure 8:
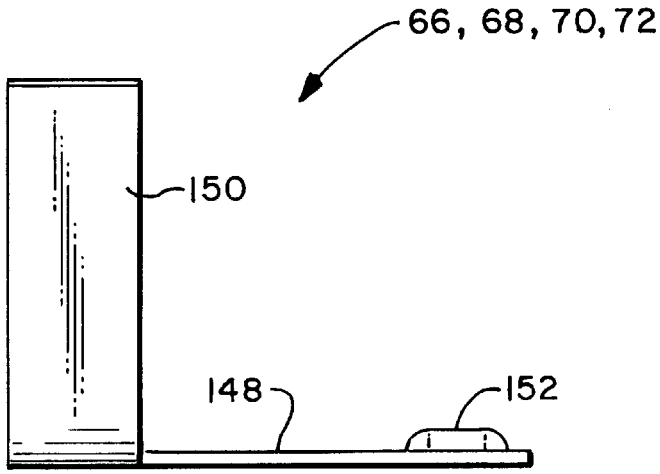
FIG. 8, is a top plan view of the actuator lever of FIG. 7.
Figure 9:
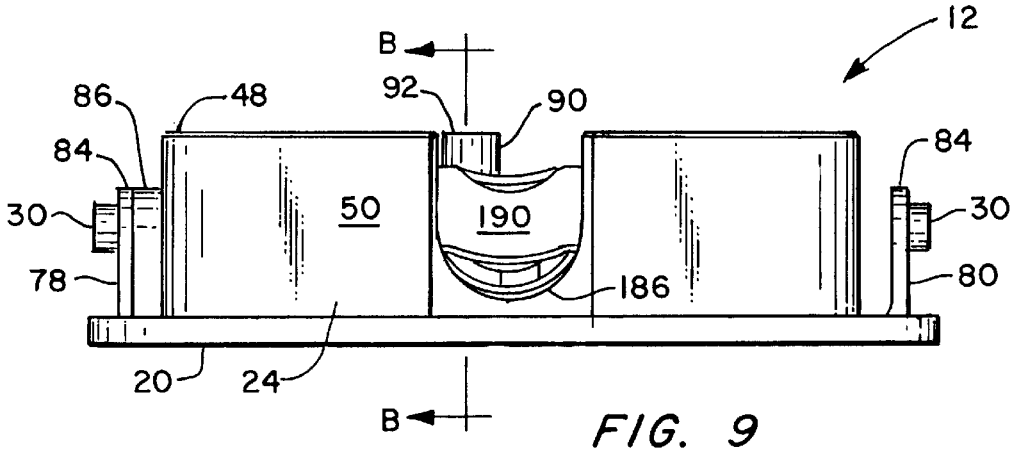
FIG. 9 is a rear elevational view of the base of FIG. 5 illustrating the cable clamp installation for clamping a small cable.
Figure 10:
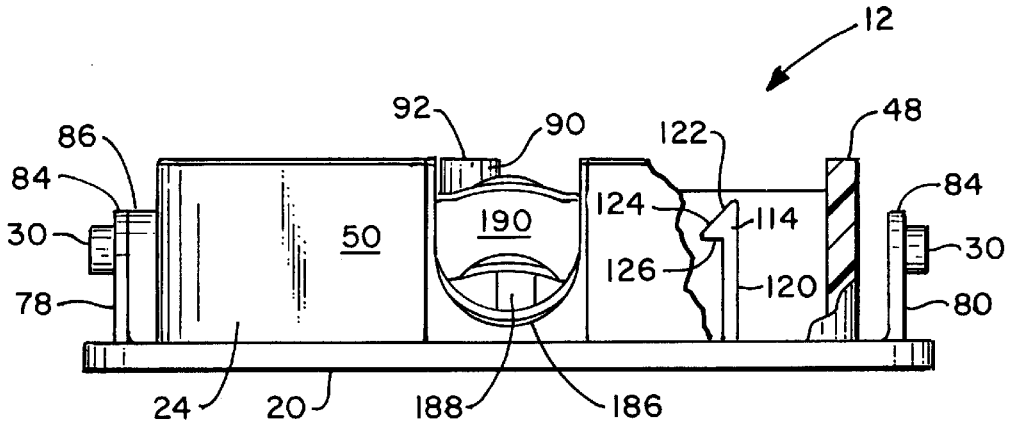
FIG. 10 is a rear elevational view substantially the same as FIG. 9, with the rim of the base partly broken away, illustrating the cable clamp installation for clamping a large cable.
Figure 16:
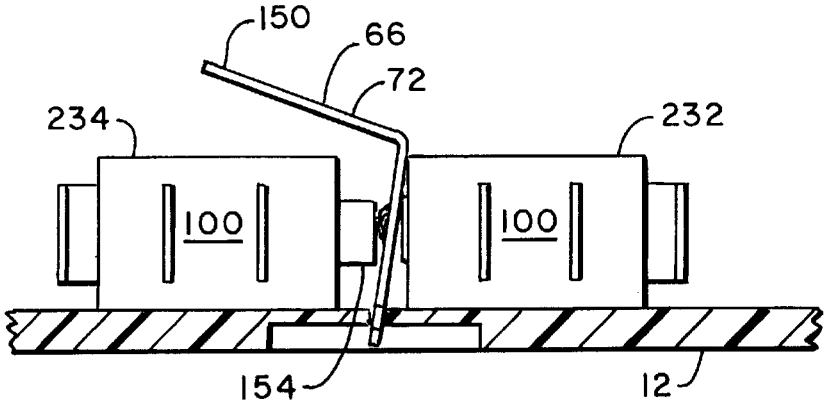
FIG. 16 is an enlarged rear elevational view, partly in section, 15 of the base, actuator lever, and switches, taken along line A—A of FIG. 15.

With reference to FIGS. 7 and 8, each actuator lever 66, 68 has a substantially rectangular actuator plate 148, an integral mounting tang 136 projecting from the bottom edge thereof, and a contact arm 150 that extends outwardly and upwardly from the top of the actuator plate 148. A protrusion 152 on the face of the actuator plate 148 is provided for engaging the switch actuator 154 for actuating the switch 100 (FIG. 4). Alternatively, the switch actuator 154 may engage the planar portion of the actuator member 148 (FIG. 16). The mounting tangs as shown take the form of a pair of tabs 160 defining upper shoulders 162, spaced from and connected to the plate 148 by the integral extension portion 164 that extends from the bottom edge of the actuator plate 148. The lengths of the tabs 160 are selected such that they effectively cooperate with the mounting slot 116. The notches 138 are offset from each other such that the distance between the notches 138 is slightly greater than the length of the extension portion 164.

An actuator lever 66, 68 is installed in the mounting slot 116 by inserting the mounting member 136 into the mounting slot 116 and rotating the actuator lever 66, 68 counterclockwise for the mounting slot 116 in the first mounting station 108 or clockwise for the mounting slot 116 in the second mounting station 110. The extension portion 164 rotates within the opening defined by the notches 138. The tabs 160 are received within the recesses 142, 144 and the retention members 146 are received within the slots 156 to retain the actuator lever 66, 68 to the base plate 20, as shown in FIG. 6.

Figure 15:
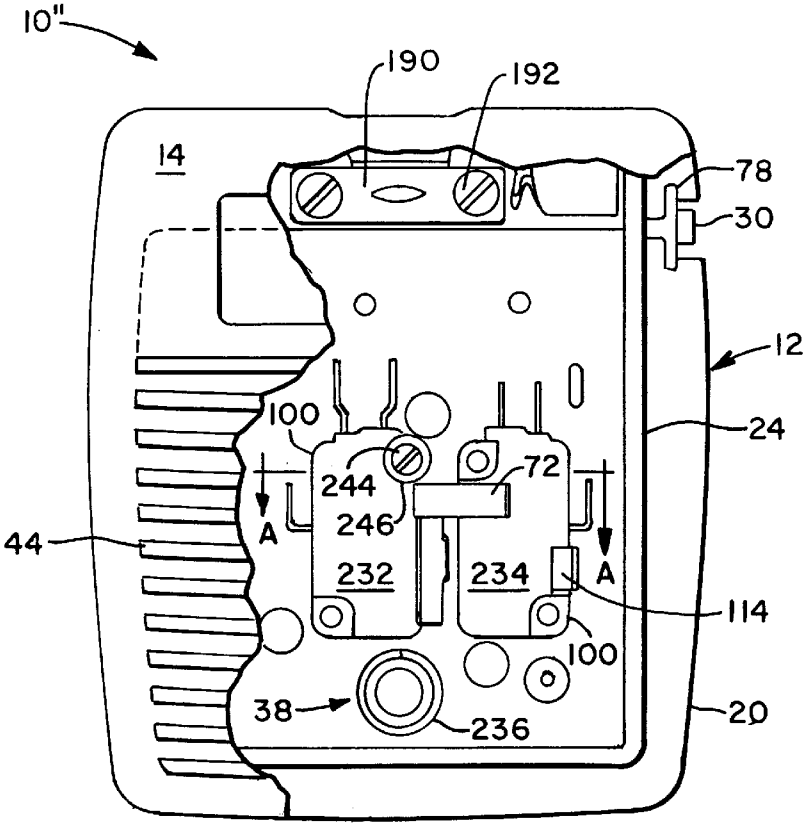
FIG. 15 is a top plan view similar to FIG. 1 of a third embodiment of a foot operated control device in accordance with the invention.

As shown in FIGS. 1 and 15, each switch 100 covers at least a portion of the associated mounting slot 116 when it is installed. Therefore, the actuator lever 66, 68 associated with the switch 100 must be installed before installation of the switch 100. The arm 150 of the actuator lever 66, 68 extends over the associated switch 100. Therefore, the mounting arrangement for the actuator levers 66, 68 must provide for movement of the arms 150 to install the switch 100. The width of the mounting slot 116 is selected to provide such movement of the actuator lever 66, 68. In the embodiment shown in the Figures, the portion of the mounting slot 116 intermediate the notches 138 has a width of 0.163 inches to allow for movement of the actuator lever 66, 68. Alternatively, the slot 116 may have a uniform width of 0.075 inches.

The rear end portion 82 of the base plate 20 includes a clamp shelf 180 that extends from the left side portion 182 of the rim 24 to the right side portion 182 of the rim 24. The shelf 180 provides additional mechanical integrity to the base 12. A generally U-shaped cradle extends through the rear portion 50 of the rim 24 and the shelf 180 for receiving an electrical cable. The cradle comprises a longitudinally extending trough 186 and two arcuate ridges 188 which extend laterally across the trough 186 within the shelf to grip the outer sheath of a cable. A cable clamp 190 is mounted to the shelf by two screws 192, or similar fasteners, to bridge the cradle and prevent relative motion between the cable and the control unit 10.

Figure 12:
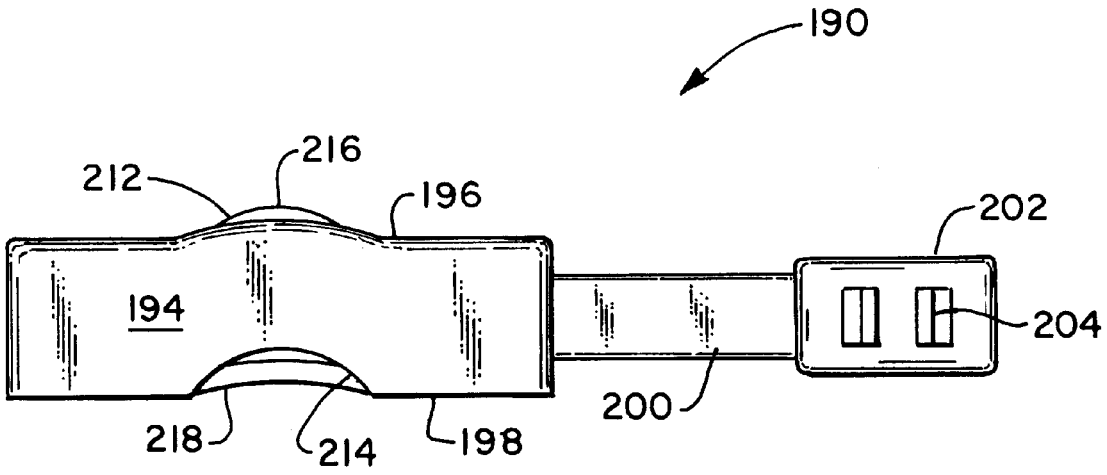
FIG. 12 is an enlarged plan view of a cable clamp shown in the control device of FIGS. 1 and 9.
Figure 13:
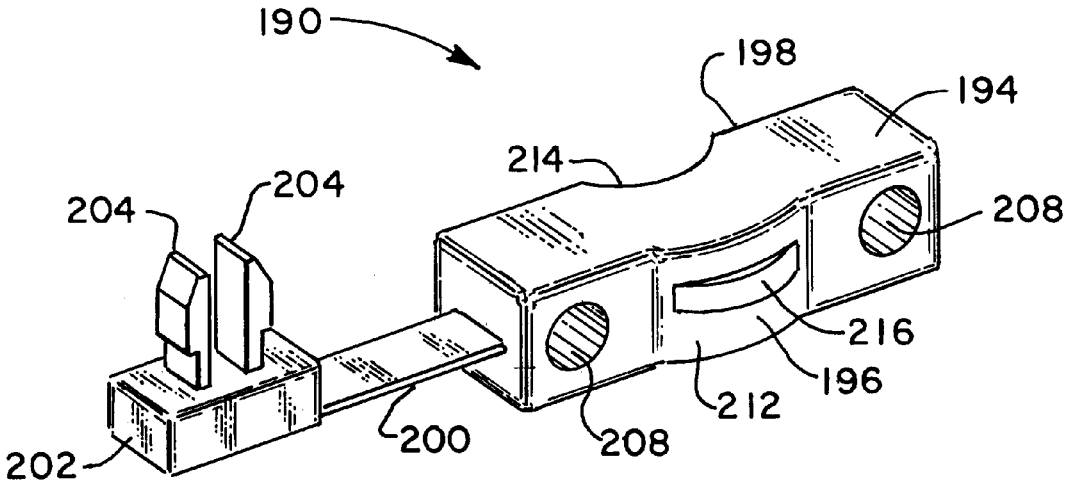
FIG. 13 is a perspective view of the cable clamp of FIG. 12.

With reference to FIGS. 12 and 13, the cable clamp 190 includes an elongated clamp body 194 having opposite shelf contacting surfaces 196,198 that alternatively confront the trough depending on whether a large or small cable is to be employed. A tether strap 200 connects the clamp 194 to a mounting member 202. Prongs 204 on the mounting member 202 are inserted into a mounting opening 206 in the shelf 180 to permanently mount the cable clamp 190 to the base 12. The tether strap 200 is sufficiently flexible that the clamp member 194 may be twisted to position either surface 196, 198 facing the cradle 186. A pair of screws 192, or similar fasteners, extend through openings 208 in the clamp member 194 to threadably engage openings 210 in the shelf. Surface 196 has an arcuate central protrusion 212 carrying a longitudinally extending rib 216 that extends outwardly from the face of the protrusion and is used to relatively clamp small diameter cables, such as those having a diameter of 0.250 to 0.310 inches. The large cable engagement face 198 has an arcuate central recess 214 that extends inwardly from the face and is used to clamp cables having a diameter of 0.310 to 0.435 inches. A rib 218 is provided in the recess 214 for firmly gripping the outer sheath of the cable.

The embodiment shown in FIG. 1 is a two stage control, having first and second switches 220, 222 and first and second actuator levers 66, 68. The first actuator peg 56 extends downwardly a greater distance than the second actuator peg 58. Consequently, the first actuator peg 56 will engage the first actuator lever 66 before the second actuator peg 58 engages the second actuator lever 68. Continued pressure on the cover 14 causes the arm 150 of the first actuator lever 66 to be pushed toward the base plate 20. As the first actuator lever 66 pivots, the protrusion 152 on the actuator member 148 pushes the switch actuator 154 into the body 130 of the switch 220, against a biasing force, to actuate the switch 220. The end of the second actuator peg 58 is sufficiently above the end of the first actuator peg 56 that the second actuator peg 58 does not engage the arm 150 of the second actuator lever 68 until the first switch 220 has been actuated. It should be appreciated that the first and second actuator pegs 56, 58 may extend downwardly the same distance if the arm 150 of the first actuator 66 extends upwardly a greater distance than the arm 150 of the second actuator lever 68.

Figure 14:
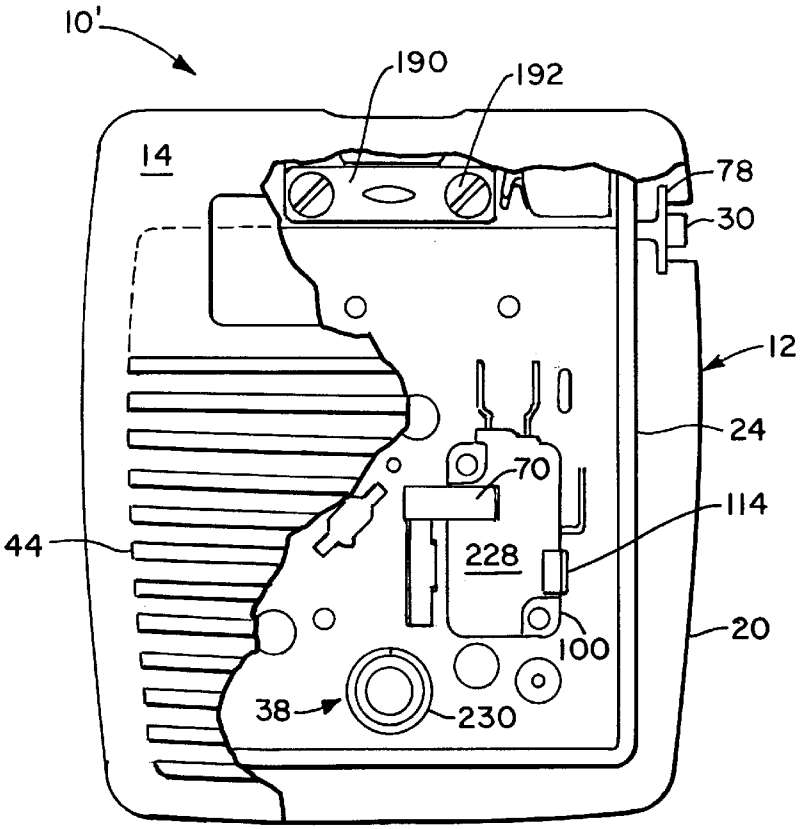
FIG. 14 is a top plan view similar to FIG. 1 of a second embodiment of a foot operated control device in accordance with the invention.

Two springs 224, 226 are utilized to bias the cover 14 away from the base 12. The length of the outer spring 224 is greater than the length of the inner spring 226, such that the inner surface 60 of the cover 14 does not engage the inner spring 226 until the first switch 220 is actuated. In addition, the spring force of the inner spring 226 is greater than the spring force of the outer spring 224. Consequently, the operator must exert a greater force on the cover 14 to overcome the biasing force of the second spring 226 than is required to overcome the biasing force of the first spring 224. Therefore, the operator must make a conscious effort to actuate the second switch 222. The embodiment shown in FIG. 14 is a single pole, double throw control, having only one switch 228, one actuator lever 70, and one spring 230.

The embodiment shown in FIG. 15 is a double pole double throw control, having first and second switches 232, 234, a single actuator lever 72, and a single spring 236. As shown in FIG. 4, each switch 100 has a spring mechanism 238 for biasing the switch actuator 154 outwardly. The first and second switches 232, 234 are selected such that the spring force on the switch actuator 154 of the second switch 234 is 500 grams and the spring force on the switch actuator 154 of the first switch 232 is 200 grams. The actuator lever 72 is disposed intermediate the first and second switches 232, 234 such that the switch actuator 154 of the first switch 232 engages one side of the actuator member 148 and the switch actuator 154 of the second switch 234 engages the opposite side. Since the spring force of the second switch 234 is much greater than the spring force of the first switch 232, the switch actuator 154 of the second switch 234 is urged outwardly, biasing the arm 150 of the actuator lever 72 upwardly, and biasing the actuator member 148 of the actuator lever 72 laterally to depress the switch actuator 154 of the first switch 232 (FIG. 16). Consequently, the first switch 232 is normally actuated and the second switch 234 is normally unactuated. Downward pressure on the cover 14 initially causes the actuator peg 58 to engage the arm 150 of the actuator lever 72. Continued pressure causes the actuator peg 58 to push the arm 150 of the actuator lever 72 toward the base plate 20. As the actuator lever 72 pivots, the actuator member 148 depresses the switch actuator 154 of the second switch 234, allowing the switch actuator 154 of the first switch 232 to be urged outward by the spring mechanism 238. Assuming that each switch is "on" when the switch actuator 154 is depressed, the first switch 232 is "on" and the second switch 234 is "off" when the cover 14 of the control unit 10 is not depressed and the first switch 232 is "off" and the second switch 234 is "on" when the cover 14 of the control unit 10 is depressed. Alternatively, one or both of the switches may be "off" when the switch actuator is depressed resulting in switch states that are opposite to those discussed above.

If both of the switches 232, 234 were mounted within the control unit 10 by the mounting brackets 114, the switches 232, 234 would be positioned too far apart to be operated by a single actuator lever 72. Consequently, the first mounting station 108 includes a third positioning post 240 and a mounting opening 242 (FIG. 5) for mounting the first switch 232 in a position that allows actuator lever 72 to actuate both of the switches 232, 234. The third positioning post 240 is inserted into one of the body openings 128 and a screw 244 is inserted through the other body opening 128 to threadably engage the mounting opening 242. An electrically non-conductive washer 246 is disposed between the head of the screw 244 and the switch body 130 to distribute the compressive force and to ensure that screw 244 does not create an electrical flow path.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A foot operated control unit for controlling a power circuit of an associated power driven device, the control unit comprising:

at least one control mechanism connectable with the power circuit for controlling the operation thereof;

at least one lever, the lever being engaged with the control mechanism;

a base adapted to be placed on a supporting surface, the base having a base plate and defining a plurality of mounting stations, each mounting station comprising a mounting bracket extending upwardly from the base plate and having a shoulder disposed over the base plate, positioning means for positioning a portion of the control mechanism between the shoulder of the mounting bracket and the base plate, and mounting means for pivotally mounting the lever to the base plate; and a foot operated actuating member pivotally mounted to the base;

wherein the lever cooperates with the actuating member for actuating the control mechanism in response to pivotal movement of the actuating member relative to the base.

2. The control unit of claim 1 wherein the positioning means comprises a positioning pin integral with the base plate and extending upwardly therefrom and the control mechanism comprises a switch having a switch body defining an opening for receiving the positioning pin.

3. The control unit of claim 1 wherein the lever comprises an actuator portion engaged with the control mechanism for actuating the control mechanism, a mounting portion mounted to the mounting means of the mounting station, and an arm engageable by the actuating member.

4. The control unit of claim 3 wherein the mounting portion of the lever means comprises first and second longitudinally extending slots defining a lock portion and an extension portion extending between the actuator portion and the lock portion, and the mounting means of the mounting station comprises a slot for receiving the extension portion and the lock portion.

5. The control unit of claim 4 wherein the mounting slot has locking means cooperating with the mounting portion for retaining the lever to the base.

6. The control unit of claim 5 wherein the locking means comprises first recess means for receiving the extension portion and second recess means for receiving the lock portion.

7. The control unit of claim 1 wherein the actuating member comprises a cover having a downwardly extending skirt, the skirt having first and second side portions, each of the side portions defining an opening, and the base further has two mounting posts, each of the mounting posts having a laterally extending mounting pin disposed in an opening of the skirt, pivotally mounting the cover to the base, at least one of the posts being flexibly laterally moveable.

8. The control unit of claim 7 wherein the other of the posts is immovably secured to the base.

9. The control unit of claim 1 wherein the base further has a shelf and a trough for receiving a cable extending through the shelf, the control unit further comprising a cable clamp having a large cable engagement face defining an arcuate recess and a small cable engagement face having an arcuate protrusion, wherein either the small cable engagement face or the large cable engagement face is alignable with the trough for clamping a cable within the cradle.

10. The control unit of claim 9 wherein the trough comprises at least one arcuate ridge which extends laterally across the trough, the protrusion on the small cable engagement face comprises a laterally extending rib and the recess in the large cable engagement face comprises a laterally extending rib, whereby the ridges of the cradle and the ribs of the clamp grip the cable.

11. The control unit of claim 9 wherein small cable engagement face and the large cable engagement face define a clamp portion and the cable clamp further comprises a mounting portion for mounting the cable clamp to the base and a flexible tether strap connecting the clamp portion to the mounting portion.

12. The control unit of claim 11 wherein the base plate defines a mounting opening and the mounting portion has a plurality of prongs, the prongs being inserted in the mounting opening to mount the cable clamp to the base.

13. The control unit of claim 1 wherein the control unit comprises a normally actuated switch defining a first control mechanism mounted in a first mounting station and a normally unactuated switch defining a second control mechanism mounted in a second mounting station, and the positioning means of the first and second mounting stations comprises an integral pin extending upwardly from the base plate, each of the switches having a switch body defining pin receiving means, the lever is disposed intermediate the switches, and one of the mounting stations further comprises an additional pin and a fastener and defines an opening, the additional pin and the fastener cooperating with the pin receiving means for mounting one of the switches, the additional pin and the opening in the base plate being positioned such that both of the switches are actuable by the lever.

14. The control unit of claim 13 wherein each of the switches has a switch actuator and the lever comprises an actuator portion engaged with the switch actuator of the normally actuated switch and the switch actuator of the normally unactuated switch, a mounting portion mountable to the mounting means of the mounting station, and an arm engageable with the actuating member.

15. The control unit of claim 14 wherein each of the switches also has means for biasing the switch actuator outwardly from the switch body, wherein the biasing means of the normally unactuated switch has a spring force that is greater than the spring force of the biasing means of the normally actuated switch, whereby the biasing means of the normally unactuated switch biases the switch actuator of the normally unactuated switch outwardly, pivoting the arm of the lever upward and pivoting the actuator portion toward the normally actuated switch wherein the actuator portion pushes the switch actuator of the normally actuated switch into the switch body, actuating the normally actuated switch, whereby pressing the actuating member pushes the arm of the lever down, pivoting the actuator portion toward the normally unactuated switch, actuating the normally unactuated switch, and allowing the biasing means of the normally actuated switch to urge the switch actuator of the normally actuated switch outward.

16. A foot operated control unit for controlling a power circuit of an associated power driven device, the control unit comprising:

at least one control mechanism connectable with the power circuit for controlling the operation thereof, the control mechanism comprising a first switch having a body and a switch actuator biased outwardly from the switch body;

lever means for actuating the control mechanism comprising a first lever having an actuator portion engageable with the switch actuator and an arm extending laterally and upwardly from the actuator portion;

a base adapted to be placed on a supporting surface, the base having a base plate defining at least one mounting station comprising a mounting bracket, positioning pin means extending upwardly from the base plate for mounting the control mechanism, and mounting means for pivotally mounting the lever means to the base plate;

a foot operated cover mounted to the base and pivotally moveable between a non-actuating position and at least one actuating position, the cover having a first actuator peg extending downwardly from an interior surface, the first actuator peg being engageable with the arm of the first lever; and spring means engaged with the base and the cover for biasing the cover to the non-actuating position, the spring means comprising a first spring;

wherein the first switch is actuated by pushing the cover to a first actuating position against the bias of the first spring, wherein the first actuator peg engages the arm of the first lever and pushes the arm down, the first lever pivots, engaging the actuator portion with the switch actuator and actuating the first switch.

17. The control unit of claim 16 wherein the control mechanism further comprises a second switch having a body and a switch actuator biased outwardly from the switch body, the lever further comprises a second lever having an actuator portion engageable with the switch actuator of the second switch and an arm extending laterally and upwardly from the actuator portion, the cover further comprises a second actuator peg extending downwardly from the interior surface wherein the first actuator peg extends downwardly a greater distance than the second actuator peg, the second actuator peg being engageable with the arm of the second lever, and the spring means further comprises a second spring, the first and second springs each having a length wherein the length of the first spring is greater than the length of the second spring, whereby pushing the cover past the first actuating position to a second actuating position causes the interior surface of cover to engage the second spring and the second actuator peg to engage the arm of the second lever, pivoting the arm of the second lever down and pivoting the actuator portion into engagement with the switch actuator of the second switch and actuating the second switch.

18. The control unit of claim 17 wherein the first and second springs each have a spring constant, wherein the spring constant of the second spring is greater than the spring constant of the first spring.

19. A foot operated control unit for controlling an associated power driven device, the control unit comprising:

a first control mechanism connectable with the power driven device for controlling the operation thereof;

a lever engaged with the first control mechanism;

a base adapted to be placed on a supporting surface, the base having a base plate and defining first and second mounting stations, each mounting station comprising a mounting bracket extending upwardly from the base plate to a shoulder disposed over the base plate, a positioning pin extending upwardly from the base plate, and a mounting slot pivotally receiving a portion of the lever; and a foot operated actuating member pivotally mounted to the base;

wherein the positioning pin of the first mounting station positions a portion of the first control mechanism between the shoulder of the mounting bracket of the first mounting station and the base plate and the lever cooperates with the actuating member for actuating the first control mechanism in response to pivotal movement of the actuating member relative to the base.

* * * * *